United States Patent [19]

Akerson

[11] 4,072,558

[45] * Feb. 7, 1978

[54] NON-COMBUSTIBLE HARDBOARD SHEET

[75] Inventor: David Wallace Akerson, St. Paul, Minn.

[73] Assignee: Conwed Corporation, St. Paul, Minn.

[ * ] Notice: The portion of the term of this patent subsequent to May 17, 1994, has been disclaimed.

[21] Appl. No.: 768,983

[22] Filed: Feb. 16, 1977

Related U.S. Application Data

[63] Continuation-in-part of Ser. No. 640,458, Dec. 15, 1975, Pat. No. 4,024,014.

[51] Int. Cl.[2] ..... D21H 5/18

[52] U.S. Cl. ..... 162/145; 162/181 C; 162/206; 162/222; 162/225; 264/119; 427/370; 427/427

[58] Field of Search ..... 162/145, 218, 222, 225, 162/204–207, 152, 155, 181 C; 427/370, 427; 100/73, 74, 93 P; 264/119, 320, 322

[56] References Cited

U.S. PATENT DOCUMENTS

| | | | |
|---|---|---|---|
| 4,007,076 | 2/1977 | Clarke et al. | 264/119 |
| 4,024,014 | 5/1977 | Akerson | 162/145 |

*Primary Examiner*—S. Leon Bashore
*Assistant Examiner*—Peter Chin
*Attorney, Agent, or Firm*—Eyre, Mann, Lucas & Just

[57] ABSTRACT

A process for preparing a non-combustible hardboard sheet is disclosed. The process comprises the formation of relatively low density insulation board type product which is dried, whereafter the board is wetted on both sides and compressed at relatively high temperatures to form a dense non-combustible hardboard product.

10 Claims, 1 Drawing Figure

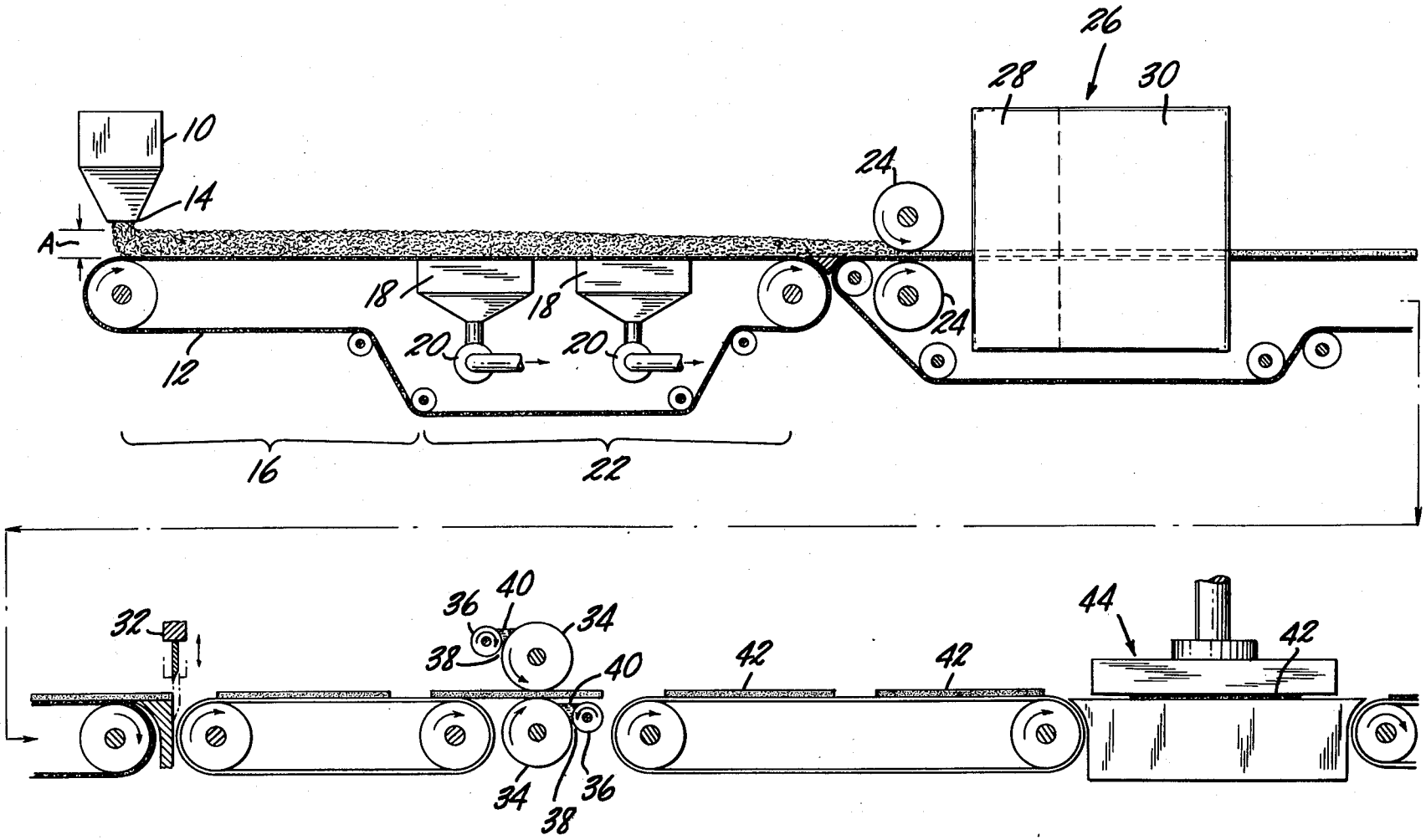
10
14
A
12
16
22
18
20
18
20
24
24
26
28
30
32
34
34
36
36
38
38
40
40
42
42
42
44

NON-COMBUSTIBLE HARDBOARD SHEET

The present application is a continuation-in-part of Application Ser. No. 640,458 filed Dec. 15, 1975 now U.S. Pat. No. 4,024,014 issued May 17, 1977.

The present invention relates to hardboard products and a method of producing same. The products are characterized by their non-combustibility.

Hardboard products are very well known in the art and have been produced for a great number of years. They are usually formed by pressing at high temperatures wood fibers to form a compressed product. In some instances a binder is added to the wood fiber composition to be pressed. Hardboard products will normally be from about 1/16 inch to about ½ inch in thickness and will have a density of from about 20 to about 70 pounds per cubic foot. The disadvantage to most commercially made hardboards is that they support combustion and therefore cannot be used in fire rated applications. While this is sometimes overcome with surface coatings and/or internal chemical treatment, this is an undesirable solution to the problem since these materials and application thereof tend to considerably increase the cost of the hardboard and in the case of the surface coatings the center portion of the structure is still combustible.

In accordance with the present invention, these disadvantages of prior art hardboards are overcome by a process for making a hardboard with a predominant portion of non-combustible materials whereby the finished hardboard is substantially non-combustible and will pass fire rating tests and will have a rating of Class A according to ASTM E-84 and a rating of 0 to 25 in the Fire Underwriters Tunnel Test. Materials which pass either or both of these tests are considered non-combustible in that they will not support combustion.

The composition from which the hardboard of the present invention is made comprises from about 60% to about 85% mineral materials. The preferred mineral materials are mineral fibers but other materials such as perlite, glass fibers and clay can also be used. The mineral materials may be present in the following amounts:

| | |
|---|---|
| mineral fibers | from about 20% to about 85% |
| perlite | from 0% to about 50% |
| other mineral materials such as long glass fibers, clay, asbestos, mica and the like | from 0% to about 25% |

The balance of the composition is made up of a binder system. The binder system comprises cellulosic fibers and a re-activatable binding agent. The binding system can comprise:

| | |
|---|---|
| Total binding system | from about 15% to about 40% |
| cellulosic fibers | from about 5% to about 15% |
| activatable binding agent | from about 10% to about 35% |

The cellulosic fibers may be wood fibers, primary or secondary paper fibers, cotton linters or the like. The fiber length will generally be up to about ¼ inch in length. The preferred fibers for use in the present invention are newsprint fibers which will generally have a length of from about ¼ millimeter to about 5 millimeters with an average length in the neighborhood of 1 millimeter.

The binders of the present invention are re-activatable binders. By the term re-activatable binder it is meant that the binder may be made to set more than one time upon the application of heat and moisture or the like. An analogous term is thermoplastic as opposed to something which is a thermoset. As is well known, a thermoplastic material softens when exposed to heat and hardens again when cooled; a thermoset material solidifies or "sets" irreversibly when heated. The re-activatable binders of the instant invention are like thermoplastic materials in that they do not take an irreversible set and can be made to soften by heat and moisture or the like after which they can be activated anew. The preferred re-activatable binder is starch. Other suitable re-activatable binders include latex binders such as vinyl acetate/acrylic copolymers, styrene-butadiene, polyvinyl acetate and the like.

The preferred composition of the present invention comprises:

| | |
|---|---|
| mineral materials | from about 78% to about 83% |
| mineral fibers | from about 62% to about 83% |
| perlite | from 0% to about 20% |
| other mineral materials | from 0% to about 1% |
| binder system | from about 18% to about 23% |
| cellulosic fibers | from about 8% to about 13% |
| re-activatable binding agent | from about 10% to about 15% |

The present invention involves a process for producing the aforesaid hardboard products.

In accordance with the process of the present invention the composition of the present invention is formed into a hardboard of from about 1/16 inch thick to about ½ inch thick, preferably from about ⅛ inch thick to about ⅜ inch thick, and having a density of from about 20 pounds to about 70 pounds, preferably from about 30 pounds to about 65 pounds, by first forming a relatively light board by a wet process, drying the board, applying water to each side of the board and then subjecting the board to heat and pressure to reduce its thickness and correspondingly increase its density by a factor of at least 1.5. It is preferred that the factor be above 2.0 and best results are achieved when it is in excess of 2.5. Thus, a board which has a dried thickness of ¾ inch and a density of about 20 pounds per cubic foot is suitable for making a hardboard product having a thickness of about ¼ inch and a density of about 60 pounds per cubic foot by employing a factor of 3.0. Similarly, a board which has a dried thickness of ½ inch and a density of about 15 pounds per cubic foot is suitable for making a hardboard product having a thickness of about ⅓ inch and a density of about 22.5 pounds per cubic foot.

These and other features of the present invention may be more fully understood with reference to the drawing in which:

The FIGURE is a schematic view showing apparatus suitable for carrying out the process of the present invention.

The composition is slurried to a solids content of from about 2% to about 5% and introduced to head box 10. The slurried composition is deposited on Fourdrinier wire 12 through orifice 14 of head box 10. Since in the instant example the finished hardboard will have a thickness of about ¼ inch, the material height at A is from about 8 to about 10 inches. The first section 16 of the Fourdrinier wire permits free drainage of water from the material and further drainage is promoted by suction boxes 18 with vacuum pumps 20 in section 22. The partially dried material is then pressed to a thickness of about ¾ inch by press rolls 24. It will be appreciated that a plurality of press rolls could be employed if desired. At this point the sheet product will generally have from about 50 to about 65% water. The sheet then passes into a drying chamber 26.

Where starch is employed as the re-activatable binding agent, it is preferable to use ungelatinized starch in the composition introduced through head box 10. The sheet product upon entering drying chamber 26 will first pass through a steam section 28 which will gelatinize the starch. Thereafter, the board passes through drying section 30 which reduces the moisture of the sheet product to a maximum moisture content of about 3% by weight and preferably less than about 1%. After leaving the dryer the sheet product is suitably cut into length as for example by cutter 32. It will be appreciated that the drawing is only intended to be a schematic and that many variations could be made. For example, in commercial production it is generally preferable to cut the sheet product after it has been pressed and before it enters the dryer. In this way, a plurality of sheets can be dried simultaneously on different levels within the drier.

The dried, preferably cut, product is then coated on both sides with aqueous solution, preferably plain water. The coating method shown is a so-called roll coater. Two rolls 34 and 36 rotatable in the direction of the arrows are employed. The rolls have a predetermined space 38 between them which controls the amount of water deposited on the board. Water 40 is fed to the V formed by the rolls on the upper side in excess amount since the amount to be supplied is controlled by the spacing 38 between the rolls 34 and 36.

Various other types of water applying devices could also be employed. For example, spray nozzles or the like could be used. Similarly, a curtain coater could be employed if desired, especially on the top of the sheet product. It is also possible to cool the board and have water condense on it from a vapor surrounding it. It will be understood that it is not necessary to simultaneously apply aqueous solution to both sides of the board and that this could be done sequentially if desired.

The amount of water to be applied to each side of the board is from about 7 pounds per thousand square feet to about 15 pounds per thousand square feet. It has been found that lesser amounts of water are not sufficient to allow good compressability of the board while greater amounts of water tend to make the board difficult to handle. The preferred amount of water applied to each side of the board is from about 10 to about 12 pounds per thousand square feet.

After the board has been treated with water, it is subjected to a simultaneous heating and pressing operation for example in platen press 40. The temperature causes the water previously applied to the surface of the board to turn into steam which will penetrate into the body of the board causing the re-activatable binder (such as starch) to soften and allow the pressure applied to densify the board without rupturing the board. The pressure applied to the board 42 is sufficient to cause a decrease in thickness and increase in density of at least one and one-half times and preferably at least two and one-half times. Since the board 42 before being coated with water will normally have a density of from about 20 to about 23 pounds and a thickness in the instant case of about ¾ inch, temperature and pressure sufficient to cause a two and one-half times reduction in size will result in a board about ⅜ inch thick and having a density of about 50–55 pounds per cubic foot. Temperature and pressure to cause a decrease in size of three times will result in a hardboard about ¼ inch thick and having a density of from about 60 to about 65 pounds per cubic foot.

After densification has taken place, the moisture (steam) will then leave the board or evaporate causing the re-activatable binder to reset prior to the release of the pressure.

While the temperatures and pressures to be employed will generally vary depending upon the specific composition of the sheet material to be made into hardboard and especially upon the type of binder, it has been found that temperatures of from about 250° to about 700° F. and preferably from about 300° to about 400° F. are suitable. The pressure to be applied can suitably be from about 200 to about 850 psi and preferably from about 400 to about 600 psi. Pressures below about 200 psi will not normally yield a product which is considered to be a hardboard product. Pressures above 850 psi can be employed but it has been found that pressures above this amount are of little benefit since even pressures as high as 1,000 psi do not compress the product to a measurably greater degree than those compressed at 850 psi.

The time of residence in the press is preferably sufficient to yield a product which will not spring back more than 20%. The minimum press time is suitably about 30 seconds and it is preferred that the material be pressed for at least one minute. It will be appreciated that as with the pressure there is no maximum press time although it has been found that press times of 5 minutes are sufficient for virtually any composition in accordance with the present invention.

While the platen press of the present invention has been shown to make a plain sheet it will be appreciated that formed shapes could be made in accordance with the process of the present invention if desired. In this case it would be preferably to form the basic shape during the initial forming operation and before entering the dryer. Such processes are well known in the art for forming shaped products.

In one specific embodiment of the present invention, a non-combustible hardboard was made from the following composition:

| | |
|---|---|
| mineral fiber | 60.6 parts by weight |
| perlite | 15.7 parts by weight |
| ungelatinized starch | 12.9 parts by weight |
| newsprint fibers | 9.8 parts by weight |
| flocculant | 1.0 parts by weight |

The material was formed into a sheet having a thickness of about ¾ inch when it exited from the dryer 26 of the FIGURE. Since the starch was ungelatinized in the formulation, steam in section 28 was used to gelatinize it. Thereafter, approximately twelve pounds of water per thousand square feet of board were applied to each side of the sheet material. The board was then pressed at a temperature of 400° F. and pressure of 410 psi which resulted in a hardboard of about ¼ inch in thickness. This board is found to be non-combustible in that it has a Class A rating according to ASTM E-84 and a rating of 0 to 25 in the Fire Underwriters Tunnel Test.

It will be understood that the claims are intended to cover all changes and modifications of the preferred embodiment of the invention, herein chosen for the purpose of illustration, which do not constitute departure from the spirit and scope of the invention.

What is claimed is:

1. A process for producing a hardboard product having a fire rating of Class A according to ASTM Test E-84 comprising:

(a) forming an aqueous slurry of solids and water said solids consisting essentially of the following ingredients:

(i) from about 60% to about 85% by weight mineral material, said mineral material consisting essentially of:

(A) from about 20% to about 85% mineral fibers;

(B) from 0% to about 50% perlite;

(C) from 0% to about 25% of other mineral materials;

(ii) from about 15% to about 40% of a binding system, said binding system consisting essentially of:

(A) from about 5% to about 15% by weight cellulosic fibers;

(B) from about 10% to about 35% of a heat and moisture re-activatable binding agent;

(b) forming a relatively light product by depositing the said aqueous slurry on a forming screen;

(c) drying the said formed product to a moisture content of no greater than about 3% by weight;

(d) applying to each side of the dried product from about 7 pounds per thousand square feet to about 15 pounds per thousand square feet of water;

(e) simultaneously heating and pressing the formed product to reduce its thickness by a factor of at least 1.5 and to increase its density by a corresponding amount.

2. The method of claim 1 wherein the temperature during the pressing operation is from about 250° F. to about 700° F.

3. The method of claim 2 wherein the pressing temperature is from about 300° F. to about 400° F.

4. The method of claim 1 wherein the pressure applied in the pressing operation is at least about 200 psi.

5. The method of claim 1 wherein the heating and pressing step has a minimum duration of at least 30 seconds.

6. The method of claim 5 wherein the heating and pressing step has a minimum duration of at least one minute.

7. The method of claim 1 wherein the said factor of step (e) is at least about 2.0.

8. The method of claim 7 wherein the said factor of step (e) is at least about 2.5.

9. A process for producing a hardboard product having a fire rating of Class A according to ASTM Test E-84 comprising:

(a) forming an aqueous slurry comprising from about 95% to about 98% water and from about 2% to about 5% solids, said solids consisting essentially of the following ingredients:

(i) from about 60% to about 85% by weight mineral material, said mineral material consisting essentially of:

(A) from about 20% to about 85% mineral fibers;

(B) from 0% to about 50% perlite;

(C) from 0% to about 25% of other mineral materials;

(ii) from about 15% to about 40% of a binding system, said binding system consisting essentially of:

(A) from about 5% to about 15% by weight cellulosic fibers;

(B) from about 10% to about 35% of a heat and moisture re-activatable binding agent;

(b) forming a relatively light product by depositing the said aqueous slurry on a forming screen;

(c) drying the said formed product to a moisture content of no greater than about 1% by weight, said dried product having a density of from about 15 to about 23 pounds per cubic foot;

(d) applying to each side of the dried product from about seven pounds per thousand square feet to about fifteen pounds per thousand square feet of water;

(e) simultaneously heating at a temperature of from about 300° F. to about 400° F. and pressing with a minimum pressure of at least about 200 psi the formed product to reduce its thickness by a factor of at least 2.0 and to increase its density by a corresponding amount, the simultaneous heating and pressing being for a period of from about 30 seconds to about 5 minutes.

10. A process for producing a hardboard product having a fire rating of Class A according to ASTM Test E-84 from a relatively light dry product having the following ingredients:

(i) from about 60% to about 85% by weight mineral material, said mineral material being composed of:

(A) from about 20% to about 85% mineral fibers;

(B) from 0% to about 50% perlite;

(C) from 0% to about 25% of other mineral materials;

(ii) from about 15% to about 40% of a binding system, said binding system being composed of:

(A) from about 5% to about 15% by weight cellulosic fibers;

(B) from about 10% to about 35% of a heat and moisture re-activatable binding agent;

(iii) said relatively light product having a moisture content of no greater than about 3% by weight; said process comprising:

(A) applying to the light, dry product from about seven pounds per thousand square feet to about fifteen pounds per thousand square feet of a solution comprising water; and, thereafter, (B) simultaneously heating and pressing the formed product to reduce its thickness by a factor of at least 1.5 and to increase its density by a corresponding amount.

* * * * *